US007515687B2

(12) United States Patent
Bernard et al.

(10) Patent No.: US 7,515,687 B2
(45) Date of Patent: Apr. 7, 2009

(54) COMPACT SOURCE WITH VERY BRIGHT X-RAY BEAM

(75) Inventors: Roland Bernard, Viuz-la-Chiesaz (FR); Benoit Barthod, Naves-Parmelan (FR)

(73) Assignee: Alcatel Lucent, Paris (FR)

( * ) Notice: Subject to any disclaimer, the term of this patent is extended or adjusted under 35 U.S.C. 154(b) by 0 days.

(21) Appl. No.: 11/618,315

(22) Filed: Dec. 29, 2006

(65) Prior Publication Data

US 2007/0153978 A1 Jul. 5, 2007

(30) Foreign Application Priority Data

Jan. 3, 2006 (FR) ..... 06 50007

(51) Int. Cl.
*H01J 35/00* (2006.01)

(52) U.S. Cl. ..... 378/127; 378/123; 378/130; 378/141

(58) Field of Classification Search ..... 378/119, 378/121–144, 199, 200
See application file for complete search history.

(56) References Cited

U.S. PATENT DOCUMENTS

| | | | | |
|---|---|---|---|---|
| 3,610,984 | A * | 10/1971 | Seki et al. | 378/125 |
| 4,107,563 | A * | 8/1978 | Oddell | 378/126 |
| 4,130,773 | A | 12/1978 | Kussel | |
| 4,417,355 | A | 11/1983 | Anisovich et al. | |
| 4,675,891 | A * | 6/1987 | Plessis et al. | 378/132 |
| 4,688,239 | A | 8/1987 | Schaffner et al. | |
| 4,943,989 | A * | 7/1990 | Lounsberry et al. | 378/130 |
| 5,107,526 | A | 4/1992 | Hoover | |
| 5,511,105 | A | 4/1996 | Knott | |
| 6,327,340 | B1 | 12/2001 | Runnoe | |

FOREIGN PATENT DOCUMENTS

| | | |
|---|---|---|
| EP | 0 170 551 A1 | 2/1986 |
| FR | 877 363 A | 12/1942 |
| FR | 2 170 955 A | 9/1973 |
| GB | 2 018 503 A | 10/1979 |
| GB | 2 131 224 A | 6/1984 |

* cited by examiner

*Primary Examiner*—Jurie Yun
(74) *Attorney, Agent, or Firm*—Sughrue Mion, PLLC

(57) ABSTRACT

Provided is a device for the emission of X-rays. The device includes a vacuum pump including a sealed peripheral casing containing a cathode which emits a flux of electrons, a rotary anode mounted at the end of the shaft of the vacuum pump, a collection device for collecting an emitted electron beam and at least one cooling element, disposed opposite one of the main radial faces of the rotary anode, which is fixed to one of the vacuum pump stator or to the sealed peripheral casing.

13 Claims, 2 Drawing Sheets

COMPACT SOURCE WITH VERY BRIGHT X-RAY BEAM

CROSS-REFERENCE TO RELATED APPLICATIONS

This application is based on French Patent Application No. FR 0650007 filed Jan. 3, 2006, the disclosure of which is hereby incorporated by reference thereto in its entirety, and the priority of which is hereby claimed under 35 U.S.C. §119.

BACKGROUND OF THE INVENTION

1. Field of the Invention

The present invention relates to rotary anode devices for generating a beam of X-rays.

2. Description of the Prior Art

There is already known, as described in the document EP-0 170 551, for example, a radiological device including a rotary anode radiogenic tube. The radiogenic tube comprises a vacuum enclosure, delimited by a sealed wall, and in which is disposed a cathode adapted to generate a flux of electrons. In the vacuum enclosure there is also a rotary anode, driven in rotation about a rotation axis by a rotor with magnetic bearings. The rotary anode receives at its periphery the flux of electrons coming from the cathode and thus emits X-rays that are directed toward an exit. The magnetic bearings are controlled to move the rotor along its rotation axis and thus to move the rotary anode, in response to a sensor of the position of the beam of X-rays at the exit, to maintain fixed the position of the beam of X-rays at the exit. This eliminates the deleterious influence of unintentional movements of the rotary anode that may result in particular from thermal expansion or from deformation of certain elements of the device.

The rotary anode X-ray emitter devices known at present are relatively bulky because, in addition to the rotary anode and its device for driving rotation in a vacuum enclosure, they necessitate an external vacuum pump to generate and to maintain the vacuum in the vacuum enclosure.

Furthermore, the known means for driving the rotary anodes in rotation generate vibrations that limit the possibilities of use in certain applications such as electronic microscopy, monitoring the crystallization of polymers, measuring small structures or multilayers in the fabrication of semiconductors.

Furthermore, the rotary anode X-ray generators used at present are costly, and require a great deal of maintenance. Also, the brightness of the source is insufficient, and there is a benefit in increasing that brightness to improve the focusing of the radiation onto small samples.

SUMMARY OF THE INVENTION

The present invention aims first of all to reduce the overall size and the cost of rotary anode X-ray generator devices.

Another object of the invention is to reduce the vibrations resulting from the rotation of the rotary anode.

A further object of the invention is to increase the brightness of the source of X-rays at the same time as reducing the consequences of the inevitable wear of the rotary anode subjected to a powerful beam of electrons.

A further object of the invention is to increase the service life of the rotary anode in this kind of high brightness X-ray source.

To achieve the above and other objects, the invention exploits the observation that molecular, turbomolecular and hybrid type vacuum pumps have now become devices driven at very high speeds, with rotation speeds that can exceed 40 000 rpm, without significant vibration.

The idea of the invention is thus to use the vacuum pump itself both to generate the vacuum in the vacuum enclosure of the X-ray generator and to produce the rotation of the rotary anode.

Thus the invention proposes a device for the emission of X-rays, comprising:

- a vacuum enclosure, delimited by a sealed wall,
- a vacuum pump connected to the vacuum enclosure to generate and maintain a vacuum therein, including a stator, a rotor and control means for the rotor enabling its stable rotation at very high speed, the stator, the rotor and the control means being contained in a sealed peripheral casing that itself constitutes all or part of the sealed wall of the vacuum enclosure,
- a cathode in the vacuum enclosure adapted to generate a flux of electrons,
- a rotary anode in the vacuum enclosure driven in rotation about a rotation axis (I-I) and receiving at its periphery the flux of electrons coming from the cathode to emit X-rays toward an exit, the anode being attached to the rotor of the vacuum pump and disposed coaxially with the rotor.

According to the invention the device further comprises at least one cooling element fixed to the vacuum pump stator or to the sealed peripheral casing opposite one of the main radial faces of the rotary anode to absorb radiated heat energy emitted by the rotary anode in operation.

At least two cooling elements are preferably provided, disposed opposite respective main radial faces of the rotary anode.

Thanks to this combination, the device is much more compact and its total overall size is minimized. At the same time its cost is reduced, since a single rotary device at one and the same time generates and maintains the vacuum and drives the rotary anode in rotation. The benefit is obtained of the excellent qualities of stability and of absence of vibrations of the vacuum pump. At the same time, the high rotation speed of the vacuum pump imparts a high rotation speed to the rotary anode, enabling the rotary anode to withstand a greater electron beam energy and to emit a beam of X-rays of greater brightness.

With the aim of producing a device for emitting X-rays with very high brightness, there is projected onto the rotary anode a high-energy beam of electrons. However, this causes rapid heating of the rotary anode. It is then beneficial to isolate the vacuum pump thermally from the rotary anode, in order to prevent it from becoming heated itself and degraded. Given the rotation speed of the pump, it is impossible to use a method of cooling by circulation of water in a hollow shaft as the problems of sealing at the connection between the rotary part and the fixed part are clearly apparent. The heat communicated to the anode by the beam of X-rays must therefore preferably be evacuated only by radiation. It is equally imperative to transmit a very small quantity of heat to the rotor of the pump, to prevent heating thereof, which, combined with the stresses caused by the very high rotation speed, would then cause deterioration of the material of which it is made (generally aluminum alloy) and destruction of the pump. With the aim of reducing unwanted heating of the vacuum pump, and of reducing the wear of the rotary anode, it is indispensable to provide means encouraging the transfer of heat from the rotary anode to the exterior during its operation.

It is therefore necessary to have the largest possible heat emission area on the anode, on the one hand, and to cool the areas facing these emissive areas and to protect the rotor of the pump from the heat radiated by the anode, on the other hand. This problem is solved by the use of a cooling element disposed opposite the anode, constituted of a material having good thermal conductivity, such as copper or aluminum, for example. This element is cooled either directly by circulation of a cooling fluid inside the element or by contact of the element with a tube in which a cooling fluid circulates, that tube being either inserted into the element or in contact with its surface.

Moreover, it is equally necessary to protect users and also the rotor of the turbomolecular pump from the X-rays emitted by the anode, to prevent deterioration of the material subjected at one and the same time to a high temperature and to high mechanical stresses, and also to a very strong flux of X-rays. A preferred solution then consists in modifying the cooling element between the anode and the pump so that it provides at the same time the thermal barrier function and the X-ray barrier function. Similarly, a cooling element situated on the opposite side of the anode may contribute equally to the absorption of the X-rays emitted by the anode, and because of this constitute a barrier to the X-rays vis a vis the exterior of the enclosure.

The element advantageously comprises a copper or stainless steel body of sufficient thickness to absorb the flux of X-rays emitted. This body may take the form of a ring, a disc or a plate, and thus provides a passage between the anode and the turbomolecular pump, in particular at the level of the rotor, to enable the pump to pump the enclosure at the level of the anode. This passage is preferably situated at the periphery of the disc or the ring.

In the case of a beam of electrons with an energy of 50 keV impinging on a tungsten target, the quantity of X-rays emitted at a point 25 cm from the target is of the order of $2.1.10^{10}$ μSv/h. In order to comply with a level of radio protection less than 0.7 μS/vh, a level of attenuation of $3.10^{-11}$ is necessary. For example, this attenuation is obtained when the X-rays pass through a 164 mm thickness of aluminum. A copper body from 8 to 13 mm thick or a stainless steel body from 14 to 19 mm thick is advantageously used, in order to combine the function of cooling (good thermal conductivity) and radio protection.

The cooling element or elements may advantageously include an internal cooling circuit through which travels a heat-exchange fluid that evacuates heat to the exterior.

The extraction of heat from the rotary anode may be further encouraged by providing for the opposite surfaces of the cooling element or elements and the rotary anode to be covered with a layer of material of high emissivity, such as black nickel or black chrome, or a ceramic.

An additional way to encourage the extraction of heat from the rotary anode is to provide an anode the materials and structure whereof are adapted to withstand higher temperatures, associated with highly effective means of thermal insulation from the vacuum pump. As a result of this the rotary anode has a higher surface temperature that encourages radiation and therefore the transfer of heat to the cooling element or elements.

Also, to improve the cooling capacity, the opposite surfaces of the cooling element or elements and the rotary anode may be indented concentrically, increasing the radiation area.

Thermal insulation means may additionally be provided between the shaft of the rotor and the rotary anode itself carried by the shaft. Such thermal insulation means may comprise a layer of ceramic produced on the corresponding surface of the shaft, for example. The ceramic has a lower thermal conductivity than the metals constituting the shaft and the rotary anode, thereby producing a barrier that slows down the propagation of heat toward the vacuum pump. This means of insulation is simple and effective and, thanks to the hardness of the ceramic, does not degrade the stability of the rotary anode.

Alternatively, the thermal insulation means may comprise a ring that is thermally insulative or has a low thermal conductivity, preferably a stainless steel ring, for example. Although stainless steel is not such a good thermal insulator as ceramic, on the other hand it has better mechanical characteristics. Another solution would be to provide between the anode and the rotor a stainless steel ring taking the highest mechanical stresses, associated with two ceramic rings fitting tightly around and holding the anode.

The presence of an appropriate gas in the interior atmosphere of the vacuum pump between the facing surfaces of the cooling elements and the rotary anode can further encourage the extraction of heat from the anode by convection. Means will be provided to limit the propagation of the gas toward the area crossed by the flux of electrons between the cathode and the rotary anode.

The vacuum pump will preferably be of the molecular, turbomolecular or hybrid pump type, enabling a high rotation speed to be obtained and a hard vacuum to be produced. The brightness of the source of X-rays may be increased in this way.

The rotary anode may preferably be a component attached to the end of a shaft coaxial with the rotor. The rotary anode can thus be an interchangeable part easily replaced when worn.

In practice, the rotary anode may have the general shape of a disc, its peripheral surface constituting at least one target that receives the flux of electrons coming from the cathode. Such a structure is simple and compact.

The impact of the electron beam on the peripheral surface of the rotary anode during operation causes progressive wear thereof. This can result in a variation of the dimensions of the rotary anode and therefore in deviation and/or defective focusing of the beam of X-rays at the exit from the device. To reduce this phenomenon, in accordance with the invention, there may be provided means for moving the rotor along its rotation axis, thereby modifying the area of impact of the beam of electrons on the periphery of the rotary anode.

In practice, the rotor may be loaded by magnetic bearings controlled by an electronic bearing control unit, this combination determining the axial position and the radial position of the rotor within the stator. The electronic bearing control unit may be adapted to modify intentionally at least the axial position of the rotor along its rotation axis.

In particular, the electronic control unit may be adapted to modify the axial position of the rotor as a function of the wear of the rotary anode, to move a worn area of the rotary anode away from the area of impact of the beam of electrons.

Another alternative or additional possibility is for the electronic control unit to be able to move the rotor to-and-fro along its rotation axis during operation, thereby moving the area of impact of the beam of electrons over a greater peripheral area of the rotary anode and thus distributing the wear over a larger area.

According to another possibility, the peripheral surface of the rotary anode may consist of a plurality of adjacent annular bands, each constituted of a different material, each is adapted to produce X-rays with a different particular energy. The electronic bearing control unit can then move the rotor axially to place under the incident beam of electrons a selected annular band corresponding to the intended application.

According to another possibility, the electronic bearing control unit may further be adapted to modify intentionally the radial position of the rotor in order to make up for the wear of the rotary anode and thus to maintain, by means of a collection device, the focusing of the beam of X-rays onto a precise convergence area at the exit.

Another function that may be implemented by modification of the radial position of the rotor is moving the focal point to modify in time the area of impact of the X-rays on the collection device and thereby to increase the service life of the collection device.

Thanks to the improvements to the properties of such a device, the invention provides for its use as a source of X-rays in a crystallization monitoring system or as a source of X-rays in a water window X-ray microscope or as a source of X-rays for measuring small structures or multilayers in the fabrication of semiconductors.

Other objects, features and advantages of the present invention will emerge from the following description of particular embodiments given with reference to the appended figures.

DETAILED DESCRIPTION OF PREFERRED EMBODIMENTS

Figure 1:
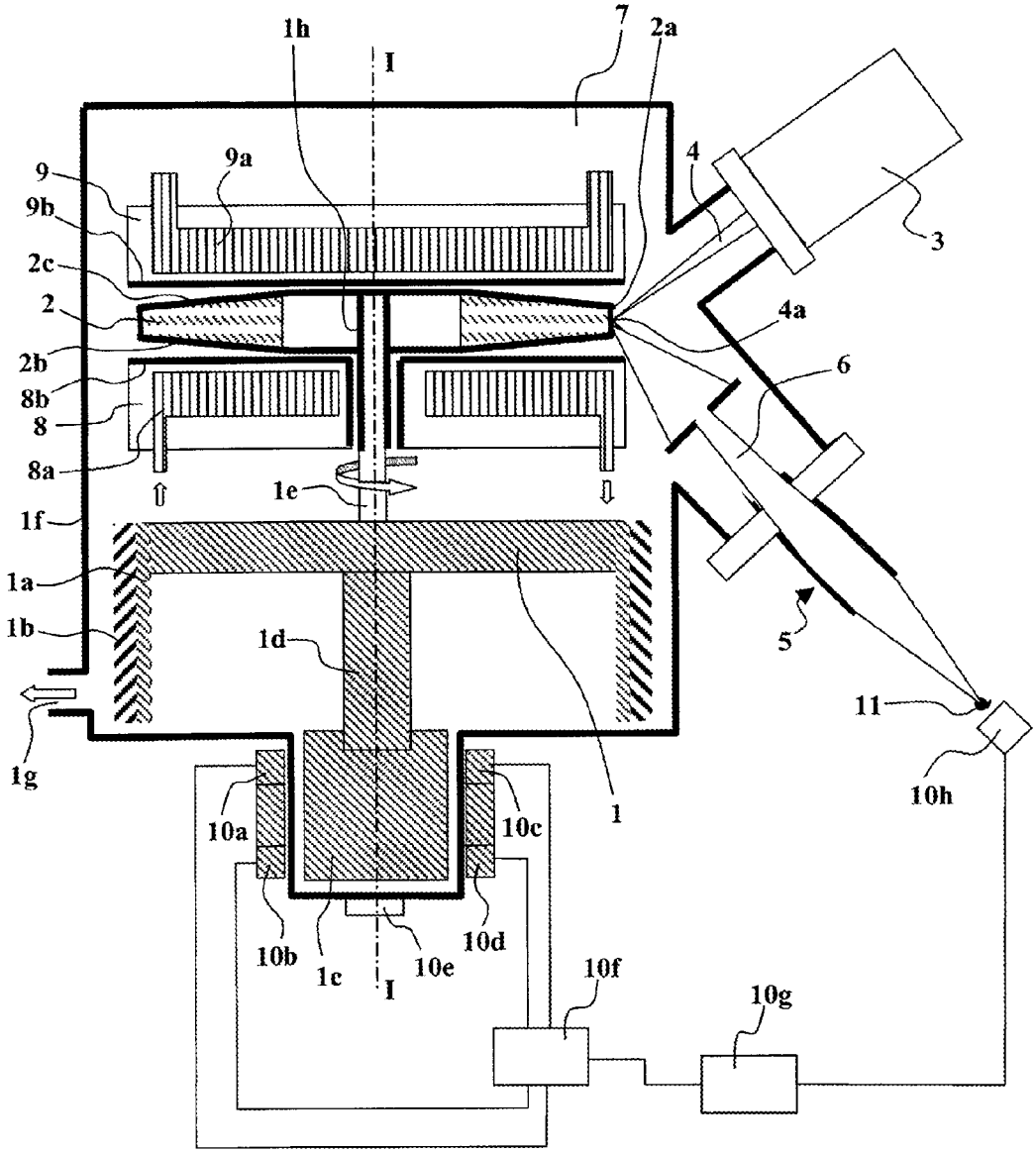
FIG. 1 is a diagrammatic side view in longitudinal section of an X-ray generator device according to one embodiment of the present invention.

The device shown in FIG. 1 comprises a vacuum pump 1, of the molecular, turbomolecular or hybrid type, a rotary anode 2, a cathode 3 generating a beam 4 of electrons, and a collection device 5 that collects and conditions the beam 6 of X-rays produced by the device.

The vacuum pump 1 comprises, in a manner that is known in the art, a rotor 1*a* mobile in rotation about an axis I-I in a stator 1*b*, driven in rotation by a motor 1*c*, and held in position by bearings 10*a*, 10*b*, 10*c*, 10*d* and 10*e* shown diagrammatically.

The bearings 10*a*-10*e* may be structures usually employed in vacuum pumps, for example ball or needle roller bearings, smooth bearings, gas bearings or magnetic bearings. The latter enable fast rotation at more than 40 000 rpm, without vibration and with controlled stability of the order of 1 micron.

The rotor 1*a* is connected to the motor 1*c* by a motor shaft 1*d*.

The rotary anode 2 is attached to the rotor 1*a* of the pump 1, disposed coaxially with the rotor 1*a*. In practice, the rotary anode 2 is a component attached to the end of a shaft 1*e* coaxial with the rotor 1*a*.

The suction elements of the vacuum pump 1, such as the rotor 1*a*, the stator 1*b* and the shaft 1*d*, are contained in a sealed peripheral casing 1*f* that may in part consist of the stator 1*b* and is provided with an evacuation exit 1*g* through which the pumped gases are discharged.

The sealed peripheral casing 1*f* of the pump also surrounds the rotary anode 2 and itself constitutes at least part of the sealed wall of a vacuum enclosure 7 in which the electron beam 4 and the X-ray beam 6 propagate. The vacuum enclosure 7 to this end contains the rotary anode 2 as well as the cathode 3 and the correction device 5. The electron beam 4 produced by the cathode 3 propagates in the vacuum, from the cathode 3, and impinges on the peripheral surface 2*a* of the rotary anode 2, producing the X-ray beam 6 that propagates toward the collection device 5.

The collection device 5 may be contained in a one-piece vacuum enclosure 7. Alternatively, the collection device 5 may be contained in a part attached to the vacuum enclosure 7.

In the embodiment shown in FIG. 1, the peripheral surface 2*a* of the rotary anode 2 is cylindrical and coaxial with the axis I-I. The cathode 3 is oriented so that the incident electron beam 4 is inclined relative to the axis I-I, which produces an emitted X-ray beam 6 that is also inclined.

Alternatively, the peripheral surface 2*a* of the rotary anode that receives the electron beam 4 may be a peripheral portion of a radial face 2*b* or 2*c* of the rotary anode 2.

The end portion of the shaft 1*e* carrying the rotary anode 2 is covered with a thermally insulative layer 1*h*, with the result that the rotary anode 2 is in contact with the layer 1*h* providing thermal insulation. This layer 1*h* may in particular comprise a stainless steel ring.

On either axial side of the rotary anode 2 there are disposed in accordance with the present invention a first cooling element 8 and a second cooling element 9, both fixed to the stator 1*b* or pump body, or to the sealed peripheral casing 1*f* of the pump, facing one of the main radial faces 2*b* or 2*c* of the rotary anode 2, which is in the form of a disc. The cooling elements 8 and 9 are in the vicinity of the main radial faces 2*b* and 2*c* of the rotary anode 2 and receive heat radiated by the rotary anode 2 in operation.

The cooling elements 8 and 9 include respective internal cooling circuits 8*a* and 9*a* through which travels a heat-exchange fluid that evacuates to the exterior heat received from the rotary anode 2.

The cooling element 8 is covered with a layer 8*b* of a material of high emissivity, for example black nickel or black chrome, or certain ceramics. Similarly the cooling element 9 is covered with such a layer 9*b*.

Similarly, the main radial faces 2*b* and 2*c* of the rotary anode 2 may each be covered with a layer of material of high emissivity. This increases the transfer of heat by radiation from the rotary anode 2 to the cooling elements 8 and 9, encouraging cooling of the rotary anode 2.

The cooling element 8 comprises an annular copper body 10.5 mm thick which serves as a barrier to X-rays and prevents them reaching the exterior of the enclosure. The copper ring could be replaced by a stainless steel ring 16.5 mm thick.

Similarly, the cooling element 9 comprises a copper body in the form of a plate or disc 10.5 mm thick that serves as a barrier to X-rays and prevents them reaching the exterior of the enclosure. The copper disc would equally well be replaced by a stainless steel disc 16.5 mm thick. However, the wall of the vacuum enclosure is usually made from stainless steel in order to protect the exterior environment in the event of failure of the pump. In the situation where the cooling element 9 is fixed to this wall, the wall itself contributes to the X-ray barrier function. The thickness of material providing total protection of the exterior from X-rays is then calculated taking account of the combination of the cooling element 9 and the wall, in order to enable the required level of attenuation to be achieved.

Means are preferably further provided for moving the rotor 1*a* along its rotation axis I-I. Clearly such axial movement of the rotor 1*a* brings about the same axial movement of the rotary anode 2, and modifies the area 4*a* of impact of the electron beam 4 on the peripheral surface 2*a* of the rotary anode 2.

For example, the rotor 1*a* may be loaded by magnetic bearings 10*a* to 10*e*, shown diagrammatically, controlled by an electronic bearing control unit 10*f*, this combination determining the axial position and the radial position of the rotor 1*a* within the stator 1*b*.

The magnetic bearings usually employed in vacuum pumps comprise a plurality of independent magnetic poles distributed over the frame and over the shaft of the vacuum pump and the magnetic field whereof is generated by coils energized by the electronic bearing control unit as a function of signals coming from position sensors also distributed between the frame and the shaft of the vacuum pump.

The position of the rotor can be controlled along five axes, comprising the longitudinal axis and four radial axes contained in two different cross section planes. However, it is also possible to control the rotor by means of electromagnets associated with an electronic control unit only along certain "active" axial or radial axes, while other, "passive" axes, controlled by permanent magnets, necessitate no such control unit.

In standard vacuum pumps, the electronic bearing control unit is programmed to maintain the axial and radial positions of the rotor 1*a* within the stator 1*b* as constant as possible.

According to the invention, in a first embodiment, the radial elements 10*a* to 10*d* of the magnetic bearings that normally position the rotor 1*a* radially maintain that radial position constant. At the same time, the axial elements 10*e* of the magnetic bearings, which position the rotor axially, are adapted so that the electronic bearing control unit 10*f* can intentionally modify the axial position of the rotor 1*a* along its rotation axis I-I. Clearly this entails modifying the axial position set point received by the electronic bearing control unit 10*f*, said set point being generated by a control circuit 10*g*.

In an alternative or additional second embodiment, the electronic bearing control unit 10*f* may also control the radial elements 10*a* to 10*d* of the magnetic bearings to modify intentionally the radial position of the rotor 1*a* within the stator 1*b*. For this the radial position set point generated by the control circuit 10*g* is modified.

The control circuit 10*g* can generate the axial and/or radial position set points as a function of information received from sensors disposed on the other members of the device according to the invention.

For example, a wear sensor 10*h* may be provided for detecting wear of the peripheral surface 2*a* of the rotary anode 2 and the signal received from this wear sensor 10*h* is used by the control circuit 10*g* to move the worn area of the rotary anode away from the area 4*a* of impact of the electron beam 4 by means of an axial movement of the rotary anode 2.

Another possibility is for the control circuit 10*g* and the electronic bearing control unit 10*f* to shift the rotor 1*a* to-and-fro along its rotational axis I-I during operation. A result of this is that the area 4*a* of impact of the electron beam 4 on the peripheral surface of the rotary anode 2 is moved, thereby distributing the wear over a larger surface, and at the same time reducing the local wear of each portion of the peripheral surface 2*a* of the rotary anode 2.

Alternatively or additionally, means may be provided for modifying the position and/or the orientation of the cathode 3, thus modifying the area 4*a* of impact of the beam 4 of electrons on the peripheral area 2*a* of the rotary anode 2.

The rotary anode 2 may be constituted entirely of the same material. Alternatively, it may be constituted of a basic material that is locally covered with the material necessary for the formation of the X-rays on its peripheral surface 2*a*. The basic material must have mechanical and thermal characteristics compatible with the operating constraints of the anode, for example aluminum, copper, stainless steel, titanium or silicon carbide, although this list is not limiting on the invention. The peripheral surface 2*a* of the rotary anode 2 may preferably be a material such as copper, molybdenum, tungsten, beryllium oxide, anodized aluminum, ceramic oxide or any other oxide, although this list is not limiting on the invention. The material would be chosen as a function of the energy necessary for the application for which the source of X-rays is intended. Copper produces X-rays at 8 keV. Molybdenum produces X-rays at 17 keV.

It may prove beneficial to make the rotary anode 2 from metal, metal being able to contribute to improved distribution and evacuation of the heat produced by the impact of the electron beam 4, compared to oxides that are poor conductors of heat at high temperatures. In other words, the metal contributes to evacuating heat throughout the rotary anode 2, preventing heat from remaining localized in the area 4*a* of impact of the electron beam 4.

The cooling elements 8 and 9 may advantageously be made from a metal that is a good conductor of heat, for example copper.

In one particular embodiment, the peripheral surface 2*a* of the rotary anode 2 may consist of a plurality of adjacent annular bands of different materials each adapted to produce X-rays at a different particular energy. For example, a first annular band of copper and a second annular band of molybdenum may be provided. The electronic bearing control unit 10*f* then enables the rotor to be moved axially to place a selected annular band under the incident electron beam 4. Placing the annular band of copper under the electron beam 4 produces X-rays at 8 keV, whereas placing the annular band of molybdenum under the electron beam 4 produces X-rays at 17 keV. Other properties of the X-rays may be obtained with bands of other materials, such as stainless steel, inconel, for example.

The rotary anode 2 may be machined symmetrically so that it can be turned over in its entirety once worn.

Figure 2:
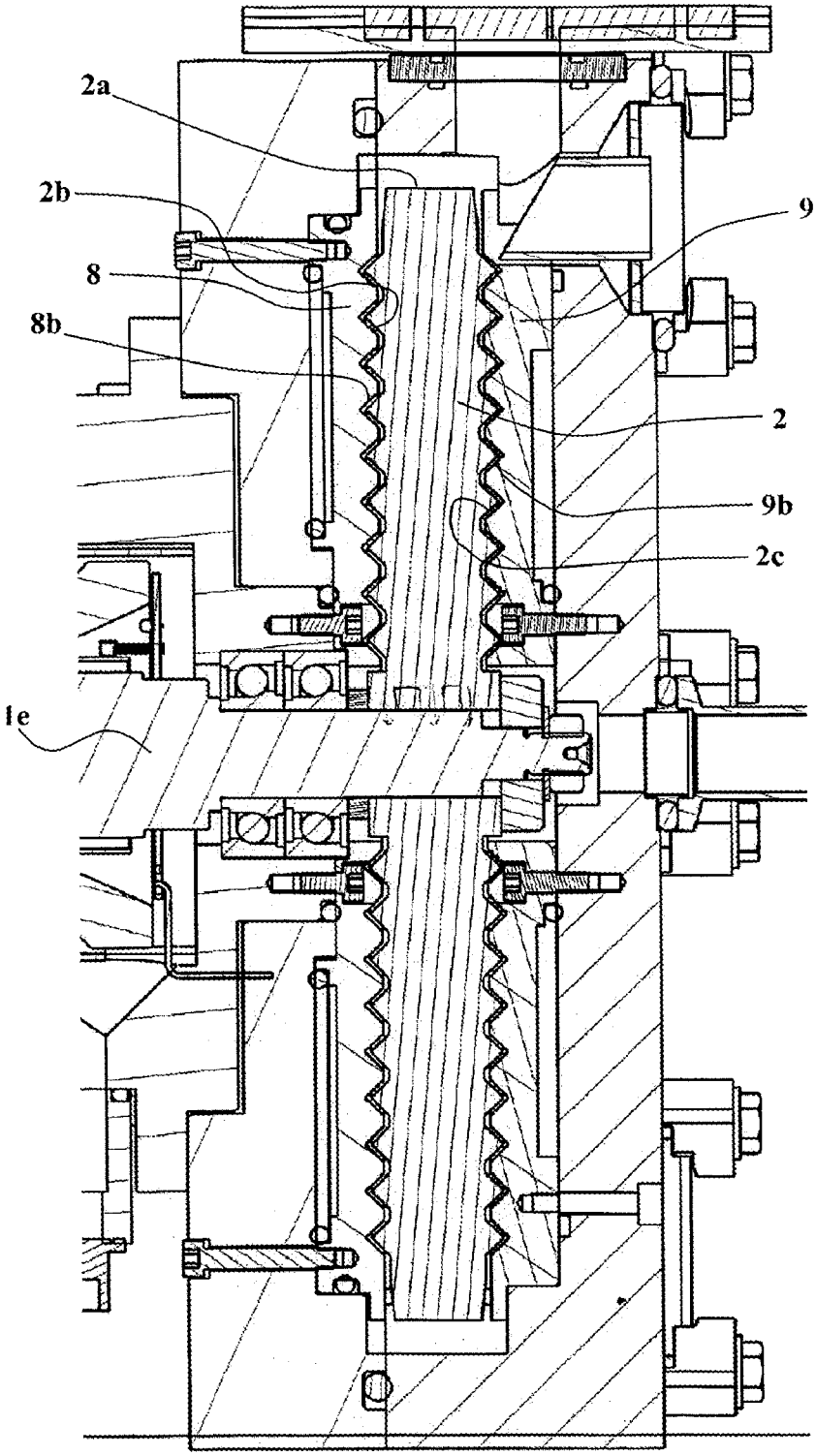
FIG. 2 is a partial side view in longitudinal section of an X-ray generator device according to a second embodiment of the present invention.

In the embodiment shown in FIG. 2, the main components of the device of the invention are seen again, namely the rotary anode 2 mounted at the end of the shaft 1*e*, the first cooling element 8, the second cooling element 9, and the peripheral surface 2*a* of the rotary anode 2.

In this embodiment, the facing surfaces 8*b* and 9*b* of the cooling elements 8 and 9 and the main radial surfaces 2*b* and 2*c* of the rotary anode 2 are indented concentrically, forming a succession of concentric triangular profile annular ribs to increase the area of heat exchange for cooling by radiation.

Considering FIG. 1 again, it is clear that wear of the peripheral surface 2*a* of the rotary anode 2 tends to move the area 4*a* of impact of the electron beam 4 toward the rotor 1*a*, which simultaneously tends to move in the same direction the area 11 of convergence of the emitted X-ray beam 6. Thus the wear sensor 10*h*, placed as shown in FIG. 1, detects the movement of the convergence area 11. To make up this wear, the electronic bearing control unit 10*f* may be adapted to modify intentionally the radial position of the rotor 1*a*, toward the right in FIG. 1, to make up the wear of the rotary anode 2 and thus to maintain the beam of X-rays focused onto the precise area of convergence 11 at the exit. To this end, any movement of the convergence area 11 at the exit may be detected by the wear sensor 10*h* and the signal produced in this way sent to the control circuit 10*g* that drives the electronic bearing control unit 10*f* in order to move the rotor 1*a* and the rotary anode 2 radially in the direction reducing this movement of the convergence area 11.

There is provided at the end of the shaft 1*e* an electrical connection device for polarizing the rotary anode 2 and evacuating the electrical current resulting from the impact of the electron beam 4. This device may be a conductive sliding contact structure. Alternatively, electrical conduction may be provided by providing, between at least a portion of the rotary anode 2 and a conductive fixed portion, an area of electrical discharge in a conductive gas.

In FIG. 2, the rotary anode 2 is in the form of a disc the edges of which are slightly inclined to direct the beam of X-rays toward the collection device 5.

The operation of turbomolecular pumps relies on a peripheral speed of the vanes of the same order as the thermal speed of the molecules, i.e. several hundred meters per second. Using the technology of vacuum pumps to rotate the rotary anode 2 therefore enables rotation at very high speeds at the peripheral surface 2*a* of the rotary anode 2, with very accurate control and almost total absence of vibrations. The very fast rotation of the rotary anode 2 means that the power of the incident electron beam 4 can be increased, thus producing an X-ray source of very high brightness.

The cathode 3 is preferably as close as possible to the peripheral surface 2*a* of the rotary anode 2 and the collection device 5 is also preferably as close as possible to the peripheral surface 2*a* of the rotary anode 2. This further enhances the compactness of the X-ray source, enhances the capacity for convergence of the emitted X-ray beam, thereby increasing the flux impinging on a sample placed in the convergence zone 11, and reduces losses.

This produces a compact, vibration-free X-ray source that delivers a monochromatic beam of great brightness focused on a very small convergence area 11.

Thanks to the qualities of such an X-ray source, its application in fields until now unexploited may be envisaged.

In a first field, the device may be used as a source of X-rays in a crystallization monitoring system. In this regard, the small size of the X-ray source according to the invention means that its use as means for systematically monitoring the crystallization of proteins may be envisaged. Such control, at present using very costly and bulky rotary anode sources, may be obtained more easily with an X-ray source according to the invention, which produces a beam of high intensity with well-defined properties (spectral purity, divergence and stability). Detection by X-rays thus means that crystallization can be monitored more accurately and automatically.

In a second application, the device according to the invention may be used as a source of X-rays in a water window X-ray microscope. In this regard, water window microscopy is a very promising technique, but at present is limited because it necessitates a very costly synchrotron source of radiation to emit X-rays of satisfactory power and monochromaticity. The cost of these sources of radiation prevents expansion of their use. With an X-ray source according to the invention, an X-ray power sufficient for an application in water window microscopy can be achieved.

The present invention is not limited to the embodiments that have been explicitly described but includes variants and generalizations thereof that will be evident to the person skilled in the art.

The invention claimed is:

1. A device for the emission of X-rays, comprising:

a vacuum enclosure, delimited by a sealed wall, a vacuum pump, comprising:

a sealed peripheral casing;

a stator, a rotor; and a control means enabling stable rotation of the rotor at a very high speed, wherein the vacuum pump is connected to the vacuum enclosure to generate and maintain a vacuum therein, a cathode disposed within the vacuum enclosure which generates a flux of electrons, a rotary anode disposed within the vacuum enclosure, which is driven in rotation about a rotation axis and receives, at its periphery, the flux of electrons coming from the cathode to emit X-rays toward an exit, and at least two cooling elements, each disposed opposite respective main radial faces of the rotary anode to absorb radiated heat energy emitted by the rotary anode in operation, wherein one of the at least two cooling elements is fixed to the vacuum pump stator and another of the at least two cooling elements is fixed to the sealed peripheral casing; wherein:

the rotary anode is attached to the rotor of the vacuum pump, and is disposed coaxially with the rotor, and the sealed peripheral casing of the vacuum pump itself constitutes at least a portion of the sealed wall of the vacuum enclosure.

2. A device according to claim 1, wherein the at least two cooling elements each comprises a copper or stainless steel body of sufficient thickness to absorb the flux of X-rays.

3. A device according to claim 1, wherein the at least two cooling elements each have an internal cooling circuit in which travels a heat-exchange fluid that evacuates heat to the exterior.

4. A device according to claim 1, wherein the opposite surfaces of each of the at least two cooling elements and of the rotary anode are covered with a layer of material of high emissivity.

5. A device according to claim 1, wherein the opposite surfaces of each of the at least two cooling elements and of the rotary anode are indented concentrically.

6. A device according to claim 1, further including thermal insulation means comprising a stainless steel ring disposed between a shaft and the rotary anode.

7. A device according to claim 1, further comprising means for moving the rotor along its rotation axis, thereby modifying the area of impact of the electron beam on the periphery of the rotary anode.

8. A device according to claim 7, wherein the rotor is loaded by magnetic bearings controlled by an electronic bearing control unit which determines its axial position and its radial position within the stator, wherein the electronic bearing control unit intentionally modifies at least the axial position of the rotor along its rotation axis.

9. A device according to claim 8, wherein the electronic control unit modifies the axial position of the rotor as a function of wear of the rotary anode, by moving a worn area of the rotary anode away from the area of impact of the electron beam.

10. A device according to claim 8, wherein the electronic control unit moves the rotor along its rotation axis during operation, thereby moving the area of impact of the electron beam on a peripheral surface of the rotary anode.

11. A device according to claim 8, wherein the peripheral surface of the rotary anode consists of a plurality of adjacent annular bands of different materials each adapted to produce X-rays with a different particular energy, the electronic bearing control unit enabling axial movement of the rotor to place a selected annular band under the incident beam of electrons.

12. A device according to claim 8, wherein the electronic bearing control unit further intentionally modifies the radial position of the rotor in order to adjust the wear of the rotary anode and thereby to maintain the X-ray beam focused on a precise convergence zone at the exit.

13. A device for the emission of X-rays, comprising:

a vacuum enclosure, delimited by a sealed wall, a vacuum pump, comprising:

a sealed peripheral casing;

a stator, a rotor; and a controller which enables stable rotation of the rotor at a very high speed, wherein the vacuum pump is connected to the vacuum enclosure to generate and maintain a vacuum therein, a cathode disposed within the vacuum enclosure which generates a flux of electrons, a rotary anode disposed within the vacuum enclosure, which is driven in rotation about a rotation axis and receives, at its periphery, the flux of electrons coming from the cathode to emit X-rays toward an exit, and at least two cooling elements, each disposed opposite respective main radial faces of the rotary anode to absorb radiated heat energy emitted by the rotary anode in operation, wherein one of the at least two cooling elements is fixed to the vacuum pump stator and another of the at least two cooling elements is fixed to the sealed peripheral casing; wherein:

the rotary anode is attached to the rotor of the vacuum pump, and is disposed coaxially with the rotor, and the sealed peripheral casing of the vacuum pump itself constitutes at least a portion of the sealed wall of the vacuum enclosure.

* * * * *